United States Patent [19]

Eager

[11] 4,223,836

[45] Sep. 23, 1980

[54] SNOWMAKING MACHINE AND METHOD

[75] Inventor: Donald W. Eager, Wallingford, Conn.

[73] Assignee: Zemel Brothers, Inc., Middlefield, Conn.

[21] Appl. No.: 967,414

[22] Filed: Dec. 7, 1978

[51] Int. Cl.[3] ..... F25C 3/04

[52] U.S. Cl. ..... 239/2 S; 239/14; 261/116; 261/118

[58] Field of Search ..... 239/2 R, 2 S, 14, 77; 62/74, 121; 261/116, 118

[56] References Cited

U.S. PATENT DOCUMENTS

| | | | |
|---|---|---|---|
| 2,886,249 | 5/1959 | Sidlow | 239/77 |
| 3,979,061 | 9/1976 | Kircher | 239/14 X |
| 4,004,732 | 1/1977 | Hanson | 239/14 X |
| 4,083,492 | 4/1978 | Dewey | 239/14 X |
| 4,105,161 | 8/1978 | Kircher et al. | 239/14 X |

OTHER PUBLICATIONS

*Hedco Snow–A Quiet Economy Blizzard*, Model H–2d Advertising Sheet, Hedco Inc., Paramus, N.J.

*Primary Examiner*—Andres Kashnikow
*Attorney, Agent, or Firm*—DeLio and Montgomery

[57] ABSTRACT

An improved snowmaking machine and method for producing artificial snow is provided, whereby a moving airstream at or below freezing temperature which is created by a motor-driven fan within a cowling is passed through an inwardly tapering conical collar attached to the downstream opening of the cowling, and water droplets are sprayed into the airstream from a plurality of nozzles distributed around an arc of preferably about 190 to 300 degrees around the opening defined by the conical collar. A mixture of water and compressed air is injected into the airstream downstream of the point the airstream exits the conical collar.

26 Claims, 2 Drawing Figures

SNOWMAKING MACHINE AND METHOD

BACKGROUND OF THE INVENTION

The invention pertains to a novel and improved snowmaking machine and method for making artificial snow utilizing the same.

The art of producing artificial snow, or ice crystals physically resembling natural snow, has grown in importance with the increased interest in wintertime sports, most notably skiing. An accompanying concern is the ability to produce the maximum quantity, as well as quality, artificial snow as efficiently as possible, particularly in view of the need to minimize the energy consumption per unit of artificial snow produced.

One of the earliest methods developed for producing artificial snow comprised mixing compressed air and water within a nozzle to effect particle formulation upon spraying of the mixture into the atmosphere at a temperature at or below freezing. Such a method was disclosed by Pierce, Jr., in U.S. Pat. No. 2,676,471. Unfortunately, this method is not only inefficient and consumes a considerable amount of energy, but the quality of the snow crystals formed is not as good as natural snow.

A substantial improvement in the method for making artificial snow was disclosed by Hanson in U.S. Pat. No. 2,968,164. Water droplets were sprayed directly into a high volume of moving air, at or below freezing temperature, which was generated by a platform-mounted fan. It was also found that snow formation could be improved by directing "seeding crystals", produced by combining compressed air and water internally in a spray nozzle, into the moving air flow into which the water droplets had been sprayed.

Following these basic developments in the air, various improvements have been made, primarily in particular combinations and refinements in the manner in which seeding crystals are formed and injected, and how water droplets are introduced into a moving airstream. Ericson in U.S. Pat. No. 3,610,527 disclosed an atomizing technique involving movement of a film of water over the surfaces of a multi-blade fan, so as to effect improved evaporation and formation of snow. Eustis et al in U.S. Pat. Nos. 3,567,117; 3,703,991; and 3,733,029 disclosed a snowmaking machine and method whereby the fan generated movement of air directed from within a tunnel-like housing in which both nozzles combining compressed air and water to form seeding crystals and a water nozzle were provided. Dewey in U.S. Pat. No. 3,948,442 disclosed a snowmaking machine with a motor-driven fan housed in a duct-like housing which also contained a nozzle for producing seeding crystals, while an array of water nozzles were provided in even distribution around the entire 360 degree circumference of the opening of the housing through which the airstream flows.

Kircher in U.S. Pat. No. 3,979,061 provided a dual array of nozzles surrounding the outside circumference of the opening of a duct within which a motor-driven fan generated an airstream, with the inner array of nozzles injecting high pressure water and the outer array of nozzles injecting compressed air in close proximity to each of the water nozzles. Finally, Kircher et al in U.S. Pat. No. 4,105,161 disclosed a method and snowmaking apparatus wherein the water nozzles are grouped in an arcuate array entirely above the center line of the airstream and a deflector is used in combination therewith to direct a lower portion of the airstream upwardly toward these nozzles, for the disclosed purpose of reducing "dribble" and increasing the loft of the snow produced and propelled outward in the airstream. Kircher et al also utilized a seeding nozzle located within the "shadow" of the deflector to improve snow particle formation.

However, the various methods and apparatus of the prior art lack the desired efficiency and ability to make both high quality and high quantities of artificial snow under all of the various types of dynamic weather and atmospheric conditions, which are experienced in locations where it is desirable to produce and distribute artificial snow on the ground surface. In accordance with the present invention, improvements have been sought and attained, both in increasing the dispersion and cooling effect upon the water droplets sprayed into the freezing airstream, as well as providing a flow designed to achieve the maximum possible time for the water droplets to be airborne, to be converted into snow crystals, and to be distributed over the maximum ground surface area.

Thus, in accordance with the invention and the improved ability to generate and disperse high quality and high quantities of artificial snow, energy requirements are further reduced, together with associated costs.

SUMMARY OF THE INVENTION

The improved snowmaking machine of the invention is of the type wherein a directional airstream is generated by a motor-driven fan mounted within an open-ended cowling and directed outwardly therefrom. A novel and unique aspect of the improved snowmaking machine of the invention is the provision of an inwardly tapering conical collar comprising an inwardly tapering frustum of a hollow cone and having its larger end dimensioned to mate with and attached to the opening defined by the cowling from which the airstream is outwardly directed. Furthermore, a plurality of water nozzles operable to inject water droplets into the airstream are distributed around the circumference of the airstream adjacent to the conical collar through an arc of at least 190 degrees around the opening defined by the conical collar. A seeding nozzle may also be provided to inject a mixture of water and compressed air into the airstream downstream of the conical collar so as to form seeding crystals.

The method of the invention comprises creation of a directional airstream at or below 0° C. by a motor-driven fan mounted within a cowling, directing the flow of said airstream through an inwardly tapering conical collar defining the frustum of a hollow cone, so as to act upon the flow of the airstream and increase the velocity and turbulence thereof, and thereafter injecting water droplets from a plurality of nozzles distributed around an arc of at least 190 degrees of the circular opening defined by the conical collar through which the airstream is directed. In addition, seeding crystals may be directed into the airstream following passage thereof through the conical collar.

It is an object of the invention to provide improved snowmaking machinery which is effective to generate a high rate and quantity of high-quality artificial snow.

It is a further object of the invention to provide an improved snowmaking machine which is reliable, adapted to facilitate fine-tuning, so as to optimize artificial snow formation under ambient and dynamic weather conditions.

It is yet a further object of the invention to provide improved snowmaking apparatus yielding increased distribution and improved artificial snow formation, both in terms of quality and quantity, with high efficiency and minimization of incompletely crystalized or excessively wet-type artifical snow.

It is an object of the invention to provide a novel and improved method for producing artificial snow, whereby both the quality and quantity of snow crystals produced are improved and can be controlled in view of ambient, dynamic weather conditions.

It is yet a further object of the invention to provide a novel and improved method for making snow which is efficient, capable of providing maximum coverage and economically efficient and effective for commercial utilization.

Other objects and advantages of the apparatus and method of the invention will be readily apparent to those skilled in the art through study of the description of the preferred embodiments set forth hereinafter and the appended claims.

DESCRIPTION OF THE PREFERRED EMBODIMENTS

Figure 1:
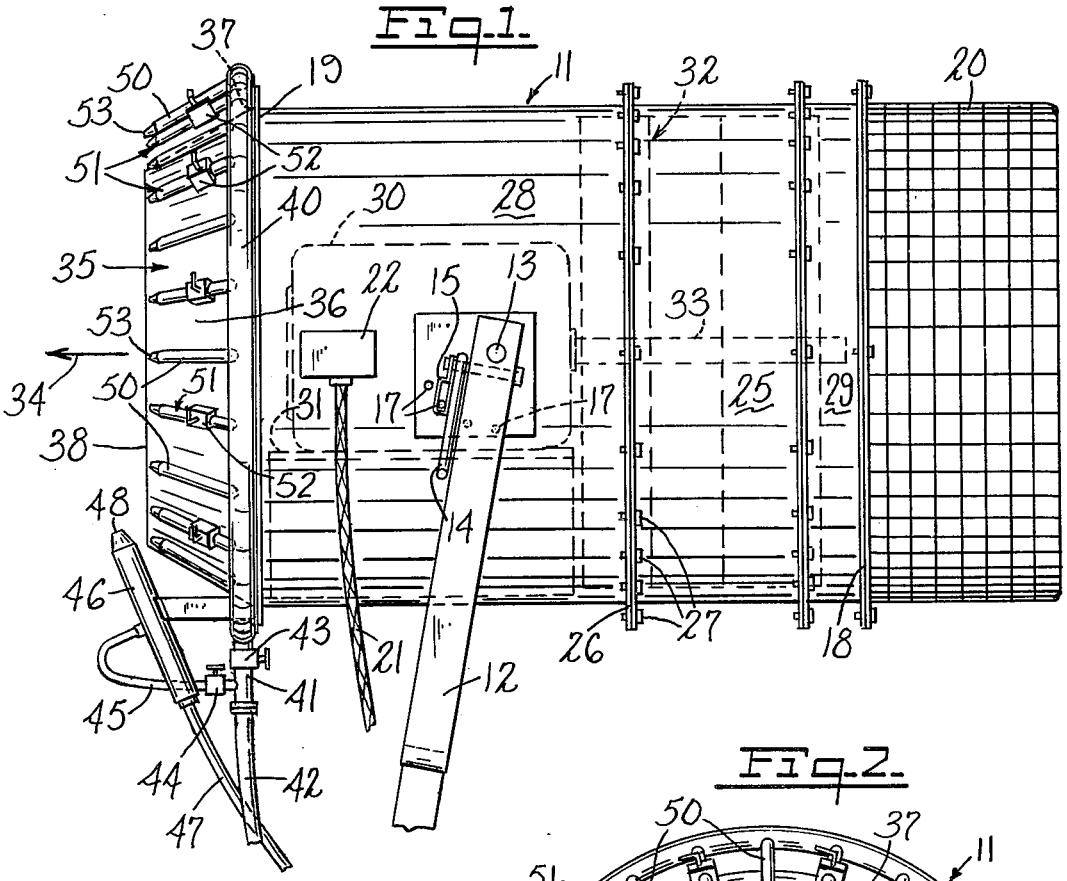
FIG. 1 is a side elevational view of the principal embodiment of the improved snowmaking machine of the invention.
Figure 2:
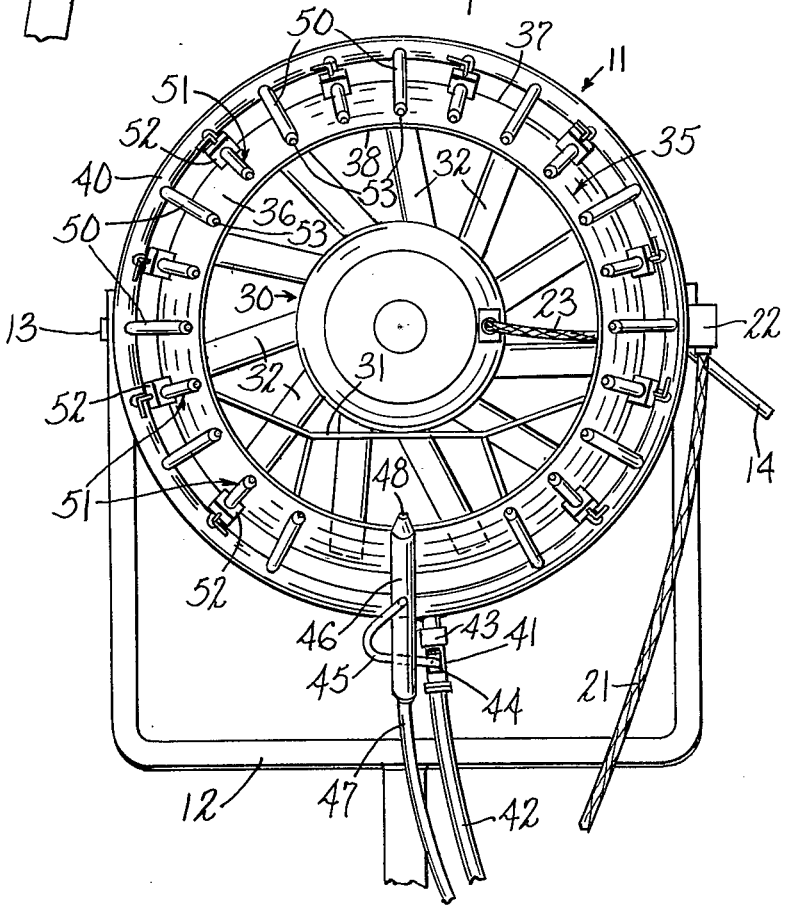
FIG. 2 is a front view of the preferred embodiment of the improved snowmaking machine of the invention.

In accordance with the present invention, one preferred embodiment is an improved snowmaking machine operable to produce artificial snow when atmospheric temperature is at or below freezing, 32° F. or 0° C. The snowmaking machine comprises a round tunnel-like cowling 11 connected by pivotal connecting bars 13 to the end of a U-shaped supporting arm 12, which is mounted on a suitable base, either of a stationary or portable type. Pivotal connecting bars 13 are oriented to provide pivotal movement of cowling 11 in the vertical plane.

A mechanism to allow the vertical position of cowling 11 to be adjusted and secured in a desired position is also provided and comprises a handle bar 14 attached at approximately a right angle to a U-shaped member 15, which is moveably connected to the upper portion of one of the support arms 12, adjacent to pivotal connection 13, and adapted for limited pivotal movement in a vertical plane transversed to the vertical plane of movement of cowling 11. A number of outwardly extending pins 71 are provided on the outside surface of cowling 11, and positioned so that one of pins 17 can be engaged by lowering U-shaped member 15 thereover, thus locking cowling 11 in the desired vertical position.

Once secured, the vertical position of cowling 11 may be changed by lifting handle bar 14, so as to disengage pin 17, changing the position of the cowling so that another of pins 17 can be engaged with U-shaped member 15, as it is lowered into position thereover. It is fully within the purview of the invention that any type of conventionally available mechanism capable of releasably securing cowling 11 in a desired vertical position can be utilized.

A protective screen 20, which preferably extends beyond the rear end 18 of cowling 11, covering the opening defined thereby, is attached to rear end 18.

An external electrical supply line 21 is connected to junction box 22 mounted on the side of cowling 11. An internal electrical line 23 extends from junction box 22 to an electrical motor 30 which is fixedly attached to mounting bracket 31, which in turn is securely mounted to the inside of cowling 11. A plurality of fan blades 32 are mounted on shaft 33 which extends rearwardly from motor 30 and is longitudinally oriented within cowling 11. Fan blades 32 are oriented and pitched, so that when motor 30 rotates shaft 33 a high velocity airstream is created having a flow 34 directed from rear end 18 to front end 19 of cowling 11.

As a matter of added convenience, a removable section 25 of cowling 11 may be provided to facilitate service of fan blades 32 and motor 30. Here, removable section 25 is provided in the region within which fan blades 32 are housed. Removable section 25 is attached to the main section 28 of cowling 11 and the rear section 29 of cowling 11 by co-mating flanges 26, which are held in firm engagement by bolts 27. It is within the purview of the invention that such a removable cowling section need not be provided, or that it may be provided with any suitable structure to facilitate access for servicing of internal parts of the snowmaking machine.

A conical collar 35, which comprises a novel and unique feature of the present invention, is provided to direct the flow 34 of the airstream as it exits through the opening defined by front end 19 of cowling 11. Conical collar 35 comprises the frustum of a hollow cone, having an inwardly tapering side 36 and a large end 37 defining an opening dimensioned to mate with and attached to front end 19 of cowling 11. The smaller end 38 of the conical collar defines a circular opening of a lesser diameter than the opening defined by large end 37.

For purposes of the invention, the angle defined by inwardly tapering side 36 of conical colar 35 may be any suitable angle which is capable of uniformly acting upon the flow 34 of the airstream, so as to increase the turbulence, velocity and cooling capacity of the airstream. While not being limited by any particular theory or explanation, it is nevertheless believed that the inwardly tapering conical shape of collar 35 produces a venturi effect, which increasing the velocity of the airstream flowing therethrough and effecting the turbulence, so as to synergistically improve both the quality and quantity of artificial snow produced.

An arcuately shaped water manifold 40 encircles the circumference of front end 19 of cowling 11 and is attached thereto. A junction 41, located at the base of manifold 40 and communicating therewith, is adapted to receive water supply line 42 and facilitate the flow of water therethrough. Junction 41 is also provided with a manifold control valve 43 and a valved "T" connection 44 which is located downstream of manifold control valve 43. A hose 45 is attached at one end to valved "T" connection 44 and at the distal end of seeding nozzle 46 to facilitate a separately regulatable flow of water to seeding nozzle 46.

A compressed air supply line 47 is attached to seeding nozzle 46, which is operable to internally combine water and compressed air and spray a mixture of the same from the nozzle orifice 48. Seeding nozzle 46 is located downstream and immediately adjacent to small end 38 of conical collar 35 and is positioned to spray seeding crystals upwardly from the lower portion of the airstream exiting small end 38. Preferably, seeding nozzle 46 is upstream of the point where water droplets are sprayed into the airstream.

It is within the purview of the invention that any conventional type of seeding nozzle can be utilized, provided that it is operable to produce a combined mixture of water and compressed air, which when injected into a moving airstream, below freezing temperature, is capable of forming seeding crystals.

A plurality of primary water nozzles 50 are attached to and communicate with water manifold 40. Each primary water nozzle 50 is incapable of separately regulating the rate of water flowing therethrough and sprayed from nozzle orifice 53. Rather, all of the primary water nozzles 50 are regulated by manifold control valve 43. Primary water nozzles 50 are oriented to direct the spray of water droplets exiting nozzle orifices 53 into the airstream at an angle and downstream of the opening formed by small end 38 of conical collar 35 and, preferably, also downstream of the point at which seeding crystals from seeding nozzle 46 are injected into the airstream.

It is fully within the purview of the invention that any type or configuration of nozzle orifice may be utilized to provide water droplets of a particular size or in a particular pattern, so as to effect the formation of artificial snow.

Primary water nozzles 50 are more or less evenly distributed around an arc of about 190 to 300 degrees in the uppermost portion of the circular opening defined by small end 38 of conical collar 35. Preferably, a plurality of primary water nozzles 50 are provided within an arc of 210 through 270 degrees. The minimum or maximum number of primary water nozzles utilized, as well as their particular distribution pattern within the arc indicated above varies and depends upon the choice of the snowmachine operator, taking into consideration the quantity and quality of snow to be produced, as well as the existing weather conditions, including wind, temperature and the like. Accordingly, it is to be understood that the present invention is not limited with respect to either the number of distribution of primary water nozzles within the arc of at least 190 degrees, as aforementioned.

Optionally, in a preferred embodiment of the improved and novel snowmaking machine of the invention, a plurality of secondary water nozzles 51, each provided with a control valve 52, may be attached to and communicate with manifold 40 and distributed within the 190 to 300 degree arc in the uppermost portion of the circular opening defined by small end 38 of conical member 35. It has been found that provision of secondary water nozzles 51 is advantageous, because they facilitate fine-tuning of the snowmaking operation. In particular, the operator of the snowmaking machine of the invention can individually adjust the rate of water flow through each of the secondary nozzles 51, so as to control the amount of water droplets each produces and injects into the airstream, again taking into consideration the existing atmospheric conditions, such as temperature, wind and the like. Thus, the operator has the ability to optimize the quality and quantity of artificial snow produced by effectively adjusting the distribution of water droplets around the aforementioned arc.

In another preferred embodiment of the invention, an improved method is provided for making artificial snow, utilizing the improved snowmaking machine herein described. In accordance with a preferred embodiment of the method of the invention, a moving airstream at or below 0° C. is generated by a motor-driven fan located within a tunnel-like cowling and having a uni-directional flow through and out of one open end of the tunnel-like cowling. It is within the purview of the invention that the directional airstream may be created or provided in any conventional manner, so long as it is directed through at least a portion of an open-ended cowling and has a temperature at or below the freezing point of water, (i.e. 32° F. or 0° C.).

The airstream flow is then directed through an inwardly tapering conical collar defining the frustum of a hollow cone, whereupon the velocity, turbulence and cooling capacity of the airstream are all increased, without increasing the tendency of adjacent water nozzles, which are located around the periphery of the airstream as it exits the conical collar to freeze or become clogged with ice. For purposes of the invention, the angle at which the side of the conical collar tapers inwardly, as well as the individual diameters and ratio of the diameters of the large open end and small open end of the conical collar may be varied, provided that the airstream directed through the conical collar is acted upon, so as to increase the velocity, turbulence and/or cooling capacity thereof. Preferably, the larger open end of the conical collar through which the airstream is passed would be of the same diameter as the tunnel-like cowling from the through which it is generated and exits. Also, it is preferred that the angle of the inwardly tapering side of the conical collar ranges between about 100 170 degrees, relative to the flow of the airstream, while the ratio of the diameter of the larger end of the conical collar to the diameter of the opening formed by the smaller end of the conical collar preferably ranges between about 10:9 to about 10:5. It is to be understood that these dimensions are illustrative, and not limiting.

Water droplets are sprayed from a plurality of individual nozzles located adjacent to and outside of the periphery of the airstream exiting the conical collar. These primary water nozzles are not individually regulatable and are distributed more or less evenly in an arc, preferably between 190–300 degrees and located in the uppermost portion of the circular opening defined by the conical collar through which the airstream is directed. Preferably, the water nozzles are distributed within an arc of 210 to 270 degrees. An arc less than 190 degrees can also be used and is operable.

While it is fully within the purview of the invention that various sizes and distribution patterns of water droplets may be utilized, it is preferred that the water droplets in the form of fine spray are injected from a plurality of water nozzles more or less evenly distributed within the aforementioned arc at an angle into the periphery of the airstream. It has been advantageously discovered that in accordance with the invention, there is less tendency for the airstream and acted upon by the conical collar of the invention and passing in close proximity to the water nozzles to cause them to freeze or clog. This reduces the maintenance and man-power costs.

Optionally, additional water droplets may be sprayed into the periphery of the airstream from secondary, valved nozzles, which are distributed within the aforementioned arc. Considering the existing atmostpheric conditions, such as temperature, wind velocity and the like, a greater or lesser amount of water droplets may be sprayed into the airstream from the secondary nozzles, so as to supplement and maximize the production of artificial snow, as well as the quality of the snow produced in accordance with the invention.

Another feature of the preferred method of the invention is the step of injecting seeding crystals into the airstream as it exits the conical collar, either in substantially the same location or upstream from the point at which the water droplets are sprayed into the airstream. Preferably, seeding crystals are injected upwardly from the lowermost portion of the opening defined by the conical collar into the airstream exiting therefrom.

Seeding crystals are, preferably, injected in the form of a mixture of water and compressed air, which are internally combined in a seeding nozzle of the well-known type. It is within the purview of the invention that seeding crystals may be formed and injected into the airstream, in accordance with any conventional method or apparatus.

In accordance with the invention, high-quality artifical snow is produced with greater overall efficiency and a net reduction in overall energy consumption. The artifical snow produced in accordance with the invention is provided in a greater quantity per unit consumed. Most notably, a greater quantity of water can be converted into artificial snow per CFM (cubic feet per minute) of compressed air used to produce seeding crystals. It is the provision of compressed air which generally involves the highest energy consumption. Thus, in accordance with the present invention, a higher rate of water converted to snow per CFM of compressed air is achieved and results in improved commercial efficiency and cost.

Furthermore, the artificial snow produced in accordance with the invention also tends to be of the more desirable powdery and less icy form, and is whiter in color, than the less desirable and grayer artifical snow of the more icy variety, typically produced by conventional snowmaking machines in accordance with conventional methods.

EXAMPLE

A snowmaking machine of the preferred embodiment herein described was utilized to produce artificial snow at Powder Ridge Ski Area in Middlefield, Connecticut, with an ambient atmospheric temperature of 28° F. The pressure of the supply line water was approximately 175–300 psi. The flow of water was regulated so that approximately 60 gallons per minute of water was consumed, most of which was passed through spray nozzles supplied by Bete Company of Massachusetts to form a fine spray directed into the airstream. Compressed air at a pressure ranging between 80 to 100 lbs. per square inch was provided to the seeding nozzle and approximately 25 CFM of compressed air was consumed to produce seeding crystals.

The interior diameter of the units' cowling was 30 inches, as was the diameter of the opening formed by the larger end of the conical collar. The smaller opening of the conical collar measured 24 inches in diameter, with the sides of the conical collar measuring 9 inches in length. The vertical angle of the machine was adjusted to throw the airstream outwardly at an angle of approximately 45 degrees in the vertical plane. The motor-driven fan was activated to generate an airstream having a flow of approximately 16,000 CFM.

Accordingly, approximately 60 gallons per minute of water was converted into high-quality snow of a powdery type and having a white color, which was distributed over the ground surface in a pattern extending outwardly beneath the flow of the airstream. A higher efficiency in terms of the amount of water converted per CFM of compressed air was achieved, in comparison to conventional snowmaking machines, for example of the type described in U.S. Pat. No. 4,051,161.

Although the above Example is given solely for purposes of illustration, it will be understood that the snowmaking machine and method may be altered, varied or modified without departing from the spirit and scope of the invention as defined by the appended claims. For example, the number, distribution and relative positioning of both the primary water nozzles and secondary individually regulatable water nozzles may be varied. One such variation could be to provide primary and/or secondary nozzles in separate concentric arrays located within the arc herein described.

Another such variation within the purview of the invention would be to provide an integrated cowling and conical collar or other functionally equivalent structure to act on the airstream in accordance with the invention.

Yet another variation within the purview of the invention would be to modify the orientation and/or relative positioning of the arc within which the water nozzles are located and the position of the seeding nozzle. For example, the arc could be in the lowermost, or for that matter any, portion of the circular opening defined by the conical collar, and the seeding nozzle could be positioned to inject seeding crystals downwardly, or from any other direction, into the airstream exiting the conical collar.

What is claimed is:

1. An improved method for making artificial snow comprising the steps of:

(a) providing a moving airstream at or below 0° C. within a tunnel-like cowling and directed out of one open end thereof, (b) passing said airstream through an inwardly tapering conical collar, said conical collar defining the frustum of a hollow cone, whereby the velocity and cooling capacity of said airstream is increased as it passes therethrough, (c) injecting seeding crystals into said airstream downstream of the point where said airstream exits said conical collar, and (d) injecting water droplets into said airstream from a plurality of nozzles distributed in an arc of between 190 to 300 degrees around the uppermost portion of the circular opening defined by said conical collar, whereby artificial snow is produced in said airstream.

2. The improved method of claim 1, wherein said airstream is passed directly from said cowling through said conical collar and is acted upon so as to increase its velocity and cooling capacity.

3. The improved method of claim 1, wherein at least a portion of said water droplets are injected from nozzles distributed around said arc, are more or less evenly distributed and adapted for simultaneous regulation of water flow therethrough.

4. The method of claim 1, wherein at least a portion of said water droplets are injected from one or more secondary nozzles distributed within said arc and adapted to individually regulate the flow of water therethrough.

5. The improved method of claim 1, wherein the flow of said airstream passed through said conical collar is acted upon to produce increased turbulence, as well as increased velocity and cooling capacity upon exit therefrom.

6. The improved method of claim 1, wherein said conical collar is dimensioned to modify the flow of said airstream passing therethrough, so as to reduce the tendency of said water nozzles positioned thereabout and adjacent thereto to freeze and clog.

7. The improved method of claim 1, wherein said seeding crystals are directed upwardly into the lower portion of said airstream exiting said conical collar.

8. The improved method of claim 1, wherein said seeding crystals are produced by injecting from a mixture of water and compressed air into said airstream.

9. The improved method of claim 1, wherein said arc is between 210 to 270 degrees.

10. In an improved snowmaking machine having in combination a motor-driven fan mounted within a tunnel-like cowling and operable to produce an airstream directed through a front opening defined by one end of said cowling, at least one nozzle operable to produce seeding crystals and oriented to inject said seeding crystals into said airstream, and a plurality of water nozzles for spray injection of water droplets into said airstream, the improvement comprising (1) provision of an inwardly tapering conical collar, said conical collar defining the frustum of a hollow cone having open ends, the larger of which is dimensioned to mate with said front opening of said cowling and is attached thereto, and (2) distribution of said water nozzles in an arc of between about 190 to 300 degrees around the uppermost portion of the circular opening defined by the smaller open end of said conical collar.

11. The improved snowmaking machine of claim 10, wherein said arc is between about 210 to 270 degrees.

12. The improved snowmaking machine of claim 10, wherein at least a portion of said plurality of water nozzles distributed around said arc are adapted for simultaneous regulation of the flow of water therethrough.

13. The improved snowmaking machine of claim 10, wherein one or more secondary water nozzles are distributed within said arc and adapted for individual regulation of the flow of water through each of said secondary water nozzles.

14. The improved snowmaking machine of claim 10, wherein said conical collar is dimensioned and said water nozzles are positioned relative thereabout, so that said water nozzles are located adjacent to, but not within, the flow of said airstream exiting from said circular opening of said conical collar, whereby the tendency of said water nozzles to freeze or clog in operation is reduced.

15. The improved snowmaking machine of claim 10, wherein said conical collar is shaped to act upon said airstream passed therethrough, so as to produce increased turbulence, as well as increased velocity and cooling capacity.

16. The improved snowmaking machine of claim 10, wherein said seeding nozzle is oriented to inject said seeding crystals upwardly into the lower portion of said airstream exiting said conical collar.

17. The improved snowmaking machine of claim 10, wherein said seeding nozzle is adapted to internally combine water and compressed air and spray a mixture of water and compressed air from its orifice, whereby said seeding crystals are produced in said airstream.

18. An improved snowmaking machine comprising, in combination:

(a) a structural supporting base, (b) a tunnel-like cowling attached to said base having opposite ends defining openings for passage of an airstream therethrough.

(c) a motor-driven fan mounted within said cowling and operable to generate a moving airstream which flows in a forward direction through said cowling, (d) an inwardly tapering conical collar attached to the upstream end of said cowling, both ends of said conical collar defining openings, with the larger end dimensioned to mate with and being attached to said upstream end of said cowling and said smaller end of a lesser diameter and the tapering sides intermediate of said ends dimensioned to act upon said airstream passing through said conical collar, so as to increase the velocity and cooling capacity thereof, (e) an arcuately shaped manifold attached to said upstream end of said cowling adjacent to said conical collar and provided with valved inlet means for receiving and regulating the flow of water therethrough, (f) a plurality of water nozzles attached to and communicating with said manifold, said water nozzles being distributed in an arc of between about 190 to 300 degrees around the uppermost portion of the circular opening defined by said conical collar, operable to spray water droplets into said airstream and oriented to direct said spray of said water droplets into said airstream downstream of the point at which said airstream exits said conical collar, and (g) at least one seeding nozzle operable to produce seeding crystals is oriented to inject the same into said airstream downstream of said point at which said airstream exits said conical collar.

19. The improved snowmaking machine of claim 18, wherein said arc is between about 210–270 degrees.

20. The improved snowmaking machine of claim 18, wherein at least a portion of said plurality of water nozzles communicating with said manifold are adapted for simultaneous regulation of the flow of water therethrough.

21. The improved snowmaking machine of claim 18, wherein one or more secondary water nozzles are distributed within said arc and each of said secondary water nozzles is provided with the individual means for regulating the flow of water therethrough.

22. The improved snowmaking machine of claim 18, wherein said water nozzles are located adjacent to, but not within, the flow of said airstream exiting said conical collar.

23. The improved snowmaking machine of claim 18, wherein said cowling is releasibly attached to said supporting base to facilitate repositioning in the vertical plane.

24. The improved snowmaking machine of claim 18, wherein said seeding nozzle is oriented to inject said seeding crystals upwardly into the lower portion of said airstream exiting said conical collar.

25. The improved snowmaking machine of claim 18, wherein said seeding nozzle is adapted to internally combine water and compressed air and spray a mixture of water and compressed air from its orifice, whereby said seeding crystals are produced in said airstream.

26. The improved snowmaking machine of claim 18, wherein said cowling is pivotally connected to U-shaped support arms forming an upper portion of said supporting base, means for releasibly maintaining the vertical orientation of said cowling are provided, and said seeding nozzles are provided with means for receiving and regulating water from said manifold and a protective screen is provided to cover the downstream opening of said cowling.

* * * * *

UNITED STATES PATENT AND TRADEMARK OFFICE

CERTIFICATE OF CORRECTION

PATENT NO. : 4,223,836

DATED : September 23, 1980

INVENTOR(S) : Donald W. Eager

It is certified that error appears in the above-identified patent and that said Letters Patent are hereby corrected as shown below:

Column 6, line 32 - "100 170 degrees" should read "100 to 170 degrees".

Signed and Sealed this

*Twenty-seventh* Day of *January 1981*

[SEAL]

*Attest:*

RENE D. TEGTMEYER

*Attesting Officer*

*Acting Commissioner of Patents and Trademarks*